US005213167A

United States Patent [19]

Best et al.

[11] Patent Number: 5,213,167

[45] Date of Patent: May 25, 1993

[54] APPARATUS FOR REDUCING VIBRATION TRANSMISSION IN HAND-HELD TOOL

[75] Inventors: Anthony Best, Wiltshire; Stephen J. Neads, Bath, both of England

[73] Assignee: Ingersoll-Rand Company, Woodcliff Lake, N.J.

[21] Appl. No.: 899,522

[22] Filed: Jun. 16, 1992

[51] Int. Cl.[5] ..... B25D 17/00

[52] U.S. Cl. ..... 173/162.2

[58] Field of Search ..... 173/162.1, 162.2, 211; 30/381

[56] References Cited

U.S. PATENT DOCUMENTS

| | | | |
|---|---|---|---|
| 2,019,964 | 11/1935 | Hamerly | 173/162.1 |
| 3,525,373 | 8/1970 | Kobayashi | 30/381 |
| 4,074,777 | 2/1978 | Andersson et al. | 173/162.1 |
| 4,217,677 | 8/1980 | Sumikawa | 173/162.2 |
| 4,385,665 | 5/1983 | Knoll | 173/162.1 |
| 4,401,167 | 8/1983 | Sekizawa et al. | 173/162.1 |
| 4,936,394 | 6/1990 | Ohtsu | 173/162.2 |
| 5,054,562 | 10/1991 | Honsa et al. | 173/162.2 |

*Primary Examiner*—Douglas D. Watts
*Assistant Examiner*—Scott A. Smith
*Attorney, Agent, or Firm*—Walter C. Vliet

[57] ABSTRACT

An air-operated percussive tool incorporates apparatus for reducing vibration transmission from a working end portion to a hand grip, thereby to reduce vibration transmission to the hand/arm of the user. The apparatus includes a male frustoconical portion whose tip is located facing a female bed with the base of the frustoconical part attached to the handle grip while the bed is attached to the working end portion. Three rubber balls are trapped between the portion and bed and the balls are located in their mean positions under compression. Oscillatory movement of the female bed parallel to the longitudinal access of the frustocone causes the balls to roll on the male and female surfaces and effectively provide a rising spring rate or stiffness. Apparatus is also disclosed for reducing vibration transmissions from the working portion to a casing of the tool.

12 Claims, 4 Drawing Sheets

APPARATUS FOR REDUCING VIBRATION TRANSMISSION IN HAND-HELD TOOL

BACKGROUND OF THE INVENTION

This invention relates generally to an apparatus for reducing vibration transmission in a hand-held tool and more particularly relates to apparatus for reducing vibration transmission from a working portion of a hand-held tool to the user of the tool.

Previous attempts to reduce hand/arm vibration in a percussive tool have generally centered around either the isolation of the operator's grip by means of sprung handles or by employing a means of cutting power to the tool as the operator force increases.

One limitation of the springs solution is that a damper is required as well as the spring in order to obtain the optimum effect. Also, the mass of the sprung handles is relatively small compared with the mass of the tool and, since a coil spring usually functions linearly, high deflections are experienced. As a result, the option to reduce the power to help achieve the desired effect has been investigated. Power regulation of the tool has obvious disadvantages to efficiency, in that it reduces the blow frequency and intensity.

The foregoing illustrates limitations known to exist in percussive tools. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, there is provided an apparatus for reducing vibration transmission from a working portion of a hand-held tool to the user of the tool, the apparatus comprising a floating, resilient ball arrangement interposed between a handle portion and the working portion of the tool.

The tool may be a percussive tool, such as a chipper, digger, needle gun, scaler, hammer drill or a demolition tool.

The tool may be air operated. The tool could also be electrically operated.

Preferably, the resilient ball arrangement comprises balls, preferably three, which can be of rubber, located between a male part on one of the portions and a female part on the other of the portions.

The male part can be a frustoconical part joined to the handle portion and the female part can be a female bed joined to the working portion of the tool or vice versa, the bed facing the frustoconical portion with the balls lying compressed on the bed and the external surface of the frustocone.

Oscillatory movement of the female bed parallel to the longitudinal axis of the frustocone causes the balls to roll on the male and female surfaces.

The balls can be located by pins or the like.

In the case of an air-operated tool, at least one and preferably each ball is provided with a bore through which air under pressure can be transmitted from the frustoconical portion to the female bed and then to the action of the working part of the tool.

According to another aspect of the present invention, there is provided an apparatus for reducing vibration transmission from a working portion of a hand-held tool to a casing of the tool, the apparatus including a floating, resilient ball arrangement interposed between the casing and the working portion of the tool.

This resilient ball arrangement can be in the form of a set of balls in a ring around the internal periphery of the casing and around the outer periphery of part of the working portion of the tool, thereby separating and isolating the two portions.

The set of balls can be linked together.

The balls can be located within shells which are curved to urge the balls towards their mean positions.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
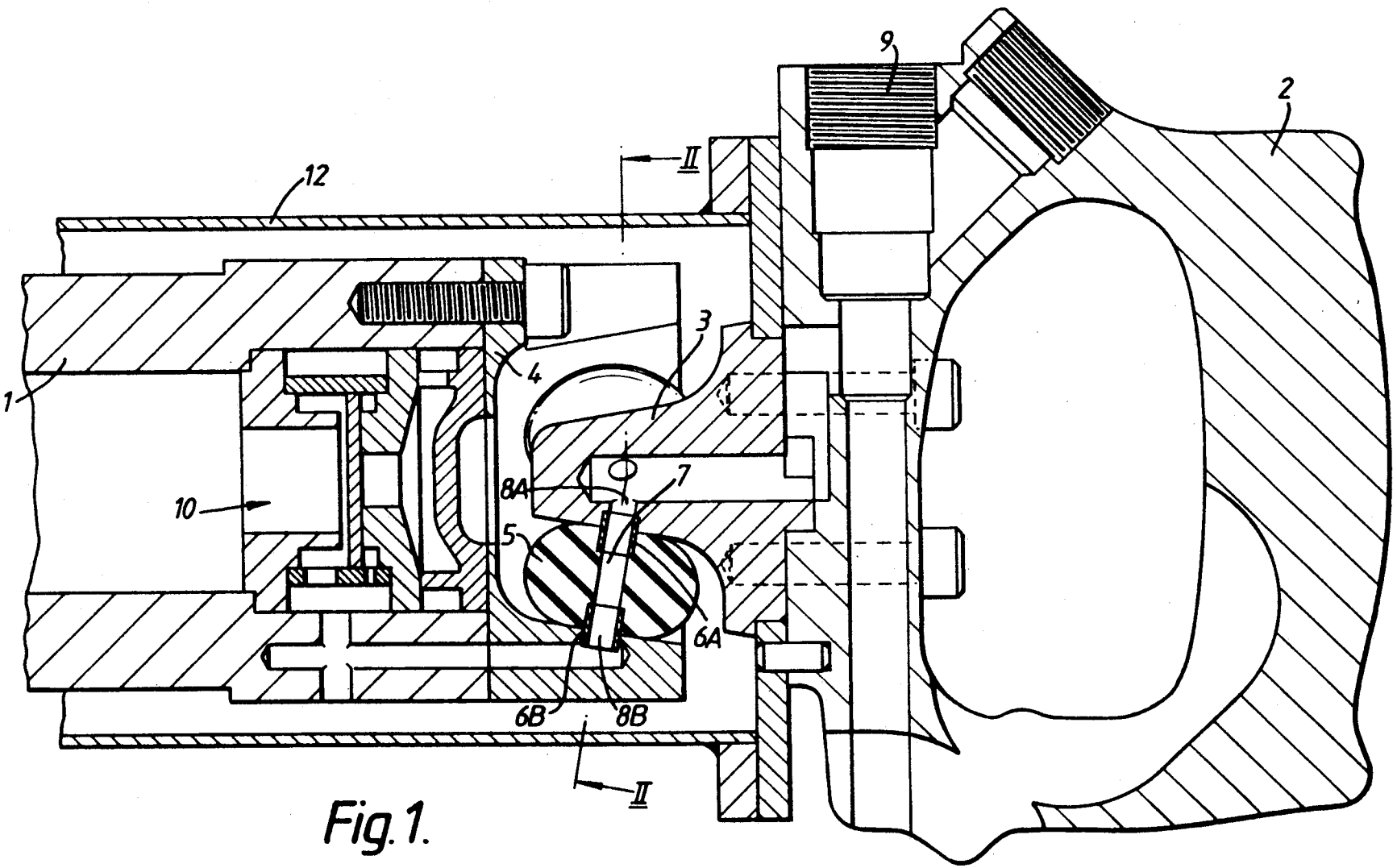
FIG. 1 is a sectional view of part of a hand-held percussive tool showing apparatus for reducing vibration transmission from a working portion thereof to the user thereof, the tool being illustrated at mid-stroke.
Figure 2:
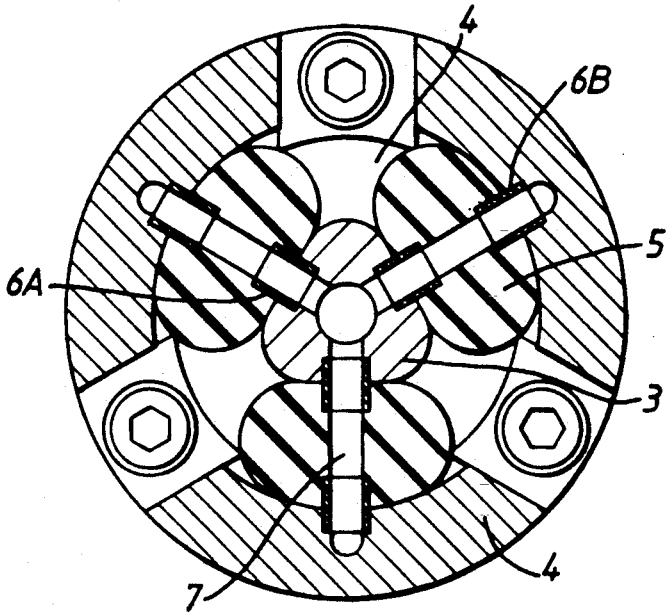
FIG. 2 is a sectional view taken on the line II—II in FIG. 1.
Figure 3:
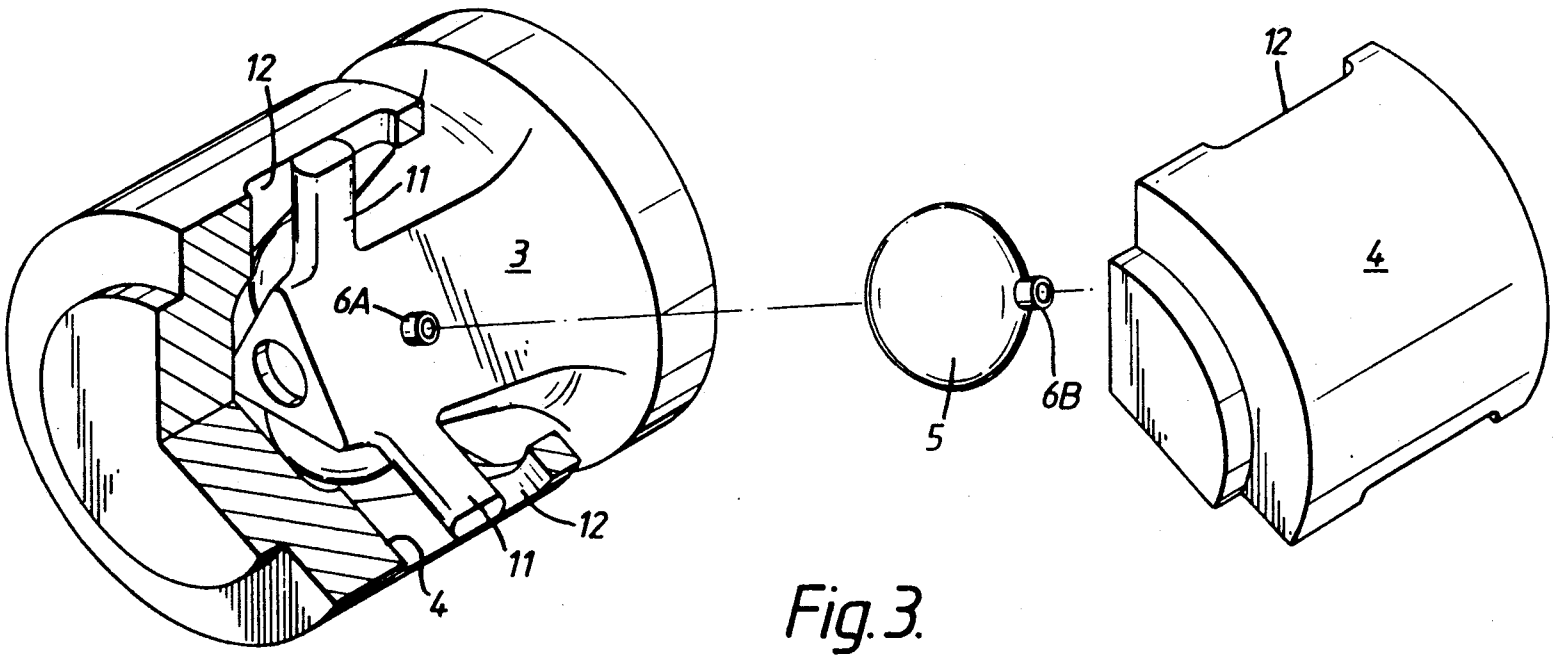
FIG. 3 is an exploded perspective view of part of the apparatus and showing a modification.

Referring to FIGS. 1 to 3, an air-operated percussive tool is illustrated which incorporates apparatus for reducing vibration transmission from a working end portion 1 to a hand grip 2, thereby to reduce vibration transmission to the hand/arm of the user. Such apparatus will be briefly referred to hereafter as the "vibration isolator".

The vibration isolator in the form illustrated comprises a male frustoconical portion 3 whose tip is located facing a female bed 4. The base of the frustoconical part is attached to the handle grip 2, while the bed 4 is attached to the working end portion 1 of the tool.

Three substantially spherical rubber balls 5 are trapped between the portion 3 and bed 4. The apparatus as depicted in FIG. 1 is carrying a mean static load.

The balls are located in their mean positions under compression by means of nylon tubes 6A and 6B located in bores 7 of the balls 5 the tubes having portions protruding from the surfaces of the balls so that these protruding portions are located in corresponding bores 8A and 8B in the portion 3 and bed 4, respectively. The tubes 6A and 6B in each bore 7 are spaced apart to give sufficient clearance for compression and expansion movement of the ball 5 in which the bore is located. The tubes 6A, 6B may be nylon inserts which are glued, bonded or simply press fits.

As illustrated, the bores form an integral part of the compressed air supply to the working end portion of the tool from an air supply bore 9 in the handle grip 2, the bore 9 passing down the center of the tapered portion 3 and communicating with the bores 8A, 7, and 8B. The bores 8B lead on to a cycle valve illustrated generally at 10. Experiments have shown that for the operating range of the vibration isolator, the airways through the vibration isolator remain sufficiently consistent to allow the required air flow.

The portion 3 need not be pure frustoconical but can be given a gently curving taper and/or can incorporate an angular change in the direction of taper. The tubes 6A and 6B serve to locate the balls 5 on the taper, especially when the parts 1 and 2 are driven off-center.

In the case where the tool is only electrically-operated, then the tubes 6A, 6B (or pins) simply serve as locating means.

The modification shown in FIG. 3 takes the form of three radially-extending wings 11 on the portion 3 which run in slots 12 parallel to the longitudinal axis of the tool. These wings also act as anti-rotation means if the rotational stiffness of the balls is overcome, thereby acting as a travel limiter. Also, they act as a rebound stop or travel limiter in the axial direction.

In use, the percussive tool will oscillate at around ±0.16 inches (4 mm) at 25 Hz/sec. The acceleration levels experienced with the balls is very high and so the resilient material of the balls must be of a suitable hardness. The apparatus provides a high radial stiffness and a low (soft) axial stiffness with rising rate. In comparison, a normal coil spring would have a constant rate. The balls effectively provide a rising spring rate or stiffness. The rising rate can be varied by varying the degree of slope on the rolling surfaces.

Figure 5:
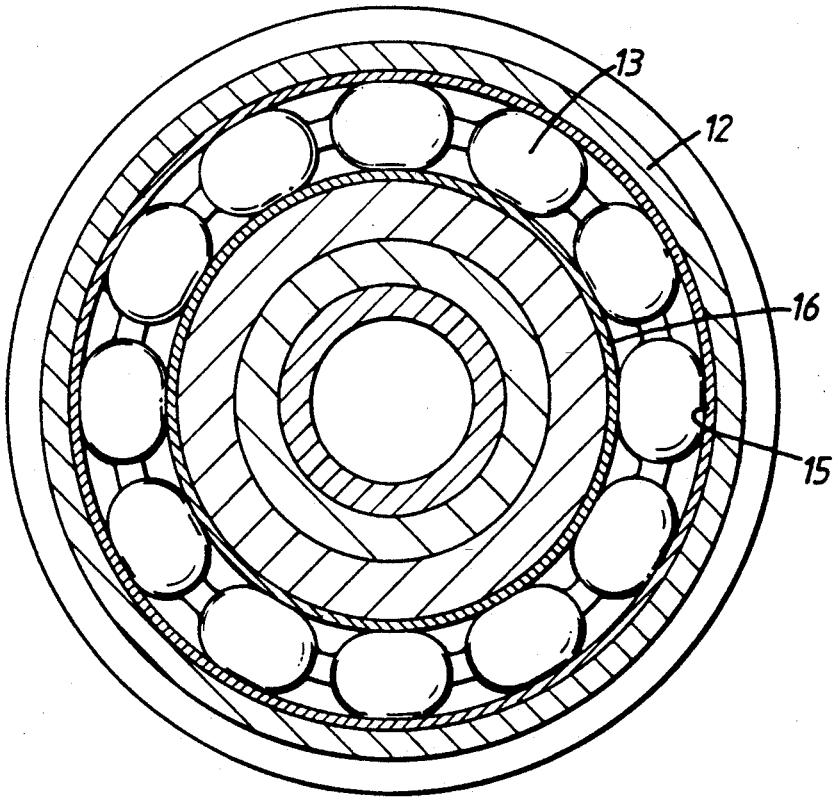
FIG. 5 is a section view taken on the line V—V in FIG. 4.
Figure 4:
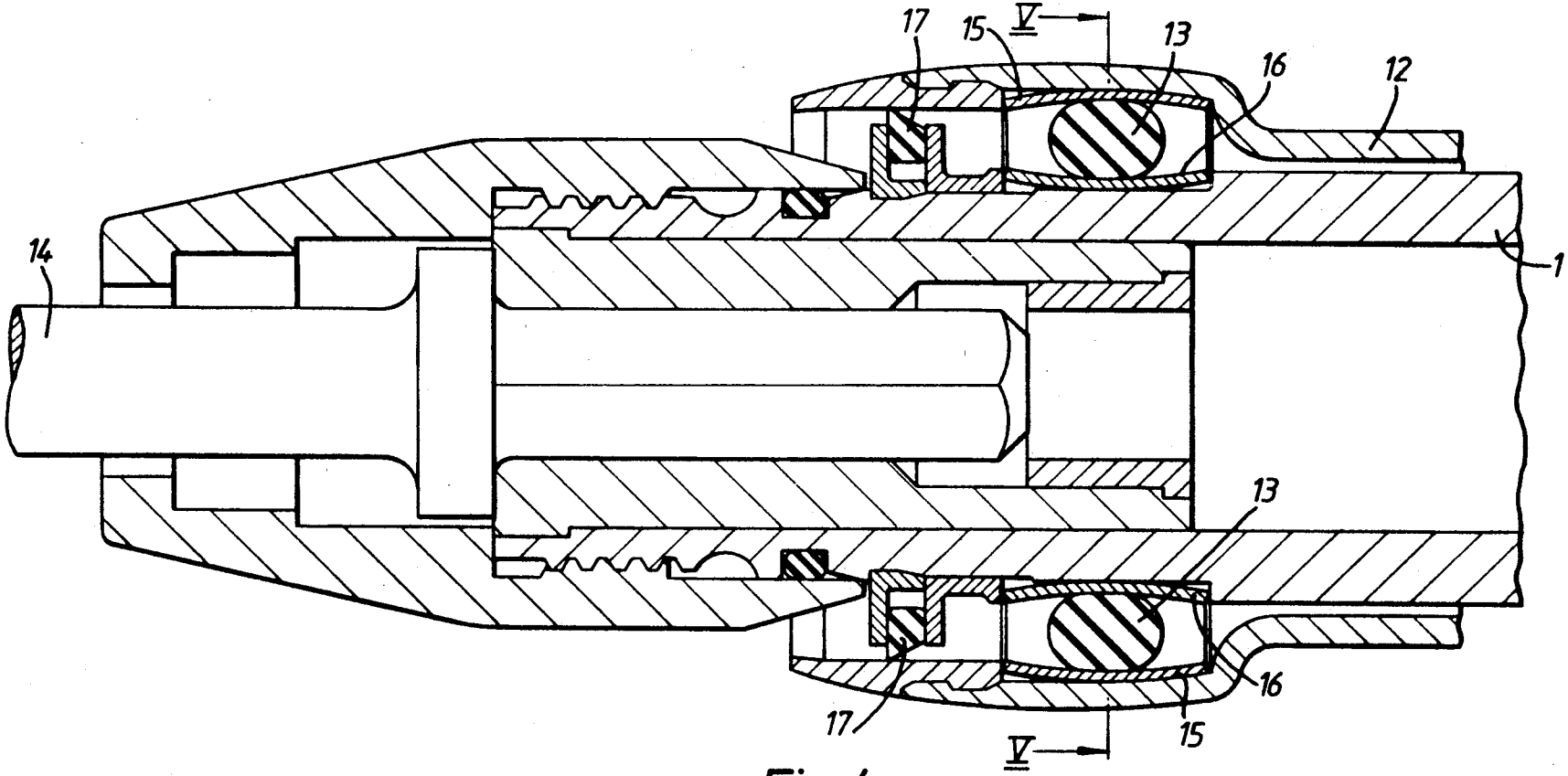
FIG. 4 is a sectional view of another part of the tool showing apparatus for reducing vibration transmission from the working portion to a casing of the tool, this view also being illustrated at mid-stroke.

The other end of the tool is diagrammatically illustrated in FIGS. 4 and 5, where a casing 12 is shown leading up to the handle end of the tool and obviously since the casing 12 is attached to the handle grip 2, it must not be allowed to short out the effect of the vibration isolator. Accordingly, another floating resilient ball arrangement 13 is provided between the working end portion 1 and the casing 12 in the region where the actual tool 14 is located. This effectively forms another vibration isolator but in this case the balls are not provided with locating pins but are linked to the ring of balls and are located in outer and inner shells 15, 16, respectively. The balls may be molded together or may be linked by other means.

In this case, the axial stiffness is intended to be lower, and with a constant rate, but the radial stiffness is intended to be higher than is the case with the vibrator isolator at the hand grip end of the tool. The shells 15 and 16 are curved to urge the bracelet of balls towards their mean positions. The balls are compressed and in this case, they have a shallow curve.

Such a construction at the end of the tool most adjacent the actual tool 14 reduces the required length in that location as compared with prior art bearings and it is resistant to ingress of foreign material. To assist in this, a circular floating seal 17 is provided between the tool 14 and the ball arrangement 13.

Having described the invention, what is claimed is:

1. An apparatus for reducing vibration transmission from a working portion of a hand-held tool to the user of the tool, the apparatus comprising:

a floating, resilient ball arrangement interposed in rolling contact between a handle portion and the working portion of the tool, wherein said resilient ball arrangement comprises a plurality of noncontacting balls.

2. An apparatus according to claim 1, wherein said resilient ball arrangement comprises three balls located between a male part on one of the portions and a female part on the other of the portions.

3. An apparatus according to claim 2, wherein the balls are of rubber.

4. An apparatus according to claim 2, wherein said male part is a frustoconical part joined to said handle portion and the female part is a female bed joined to the working portion of the tool.

5. An apparatus according to claim 2, wherein the balls are located by pins.

6. An apparatus according to claim 4, wherein at least one of said balls is provided with a bore through which air under pressure can be transmitted from the frustoconical portions to the female bed and then to the action of the working part of the tool.

7. An apparatus according to claim 1, further comprising: means for reducing vibration transmission from a working portion of the tool to a casing of the tool, said means including a second floating, resilient ball arrangement interposed between the casing and the working portion of the tool.

8. An apparatus according to claim 7, wherein said second resilient ball arrangement is in the form of a set of balls in a ring around the internal periphery of the casing and around the outer periphery of part of the working portion of the tool, thereby separating and isolating the two portions.

9. An apparatus according to claim 8, wherein the balls in said set of balls are linked together.

10. An apparatus according to claim 8, wherein the balls of the set of balls are located within shells which are curved to urge those balls towards their mean positions.

11. An apparatus according to claim 2, further comprising: means to limit relative rotation between said male and female parts.

12. An apparatus according to claim 2, further comprising: means for acting as a rebound stop or travel limiter in an axial direction of relative movement of the male and female parts.

* * * * *